United States Patent [19]

Kimura et al.

[11] Patent Number: 4,920,021

[45] Date of Patent: Apr. 24, 1990

[54] ELECTROPHOTOGRAPHIC PHOTOSENSITIVE MEMBER

[75] Inventors: Tomohiro Kimura, Kawasaki; Yoichi Kawamorita, Yokohama, both of Japan

[73] Assignee: Canon Kabushiki Kaisha, Tokyo, Japan

[21] Appl. No.: 220,165

[22] Filed: Jul. 18, 1988

[30] Foreign Application Priority Data

Jul. 20, 1987 [JP] Japan ..... 62-178946

[51] Int. Cl.[5] ..... G03G 5/05

[52] U.S. Cl. ..... 430/56; 430/57; 430/58

[58] Field of Search ..... 430/66, 67, 56, 57, 430/58

[56] References Cited

U.S. PATENT DOCUMENTS 4,256,823 3/1981 Takahashi ..... 430/66

4,716,091 12/1987 Yoshihara ..... 430/66

*Primary Examiner*—J. David Welsh

*Attorney, Agent, or Firm*—Fitzpatrick, Cella, Harper & Scinto

[57] ABSTRACT

An electrophotographic photosensitive member comprises a photosensitive layer on an electroconductive substrate, the surface layer of said photosensitive layer containing lubricating resin powder and a silicon type graft polymer containing silicone in the side chain.

12 Claims, No Drawings

ELECTROPHOTOGRAPHIC PHOTOSENSITIVE MEMBER

BACKGROUND OF THE INVENTION

1. Field of the Invention

This invention relates to an electrophotographic photosensitive member, particularly to an electrophotographic photosensitive member having excellent mechanical strength, surface lubricity, humidity resistance and image characteristic.

2. Related Background Art

An electrophotographic photosensitive member is demanded to be provided with certain sensitivity, electrical characteristic, optical characteristic corresponding to the electrophotographic process for which it is to be applied, and further in a photosensitive member which is used repeatedly, since electrical, mechanical external forces are directly applied such as corona charging, toner development, transfer onto paper, cleaning treatment, etc. on the surface layer of the photosensitive member, namely the layer which is the most remotest from the substrate, durability to such treatments is demanded. More specifically, durability to generation of abrasion or flaws on the surface by sliding, and also to deterioration of the surface with ozone generated during corona charging under highly humid conditions, etc. has been demanded.

On the other hand, there is also the problem of toner attachment onto the surface layer by development of toner, repetition of cleaning, and to cope with this problem, it has been demanded to improve cleaning characteristics of the surface layer.

For satisfying the demanded characteristics as mentioned above, various methods have been investigated, and among them it is effective to disperse a solid lubricating agent, particularly a fluorine type resin powder in the surface layer of the photosensitive member, as disclosed in Japanese Patent Laid-Open Application No. 57-747478, U.S. Pat. Nos. 4,030,921 and 4,663,259. By dispersing fluorine type resin powder, durability to flaws, surface cleaning characteristics, abrasion, etc. can be improved, and it is also effective for prevention of surface deterioration of the photosensitive member under highly humid conditions because it can improve water repellency, mold releasability of the surface of the photosensitive member.

Also, when a layer containing fluorine type resin powder dispersed therein is provided as a protective layer, the charge transport material or the charge generation material which is susceptible to deterioration with ozone is separated from the surface, whereby durability can be further improved.

However, when a coating solution containing fluorine type resin powder is coated to form a coating in order to form the surface layer of the photosensitive layer, the outermost surface of the coating formed has no fluorine type resin powder exposed thereon, but a binder resin covers the surface of the coating. For this reason, the effect as described above when fluorine resin powder is dispersed will not appear at all at the initial stage of using the photosensitive member. As the result, for example, troubles such as fusion between the cleaning blade and the surface of the photosensitive member, damage of the drum surface by reverse rotation of cleaning blade, etc. will frequently occur. For prevention of such troubles, measures such as special spraying of toner or lubricating powder, artificial cutting of the surface, etc. must be taken during usage, whereby the cost cannot but be increased with respect to installation or labor to involve a problem in practical application.

SUMMARY OF THE INVENTION

An object of the present invention is to provide an electrophotographic photosensitive member which can impart lubricity from the initial stage of using the photosensitive member and also maintain durability to generation of abrasion or flaw on the surface by sliding and high humidity resistance continuously. Another object of the present invention is to provide an electrophotographic photosensitive member of high quality, particularly high sensitivity, in a repeated electrophotographic process.

The present inventors have investigated intensively according to such objects, and consequently it has been rendered possible to provide a photosensitive member which has solved the problems as described above and has excellent electrophotographic characteristics.

According to the present invention, there is provided an electrophotographic photosensitive member having a photosensitive layer on an electroconductive substrate, the surface of the photosensitive member containing lubricating resin powder and a silicone type graft polymer having silicone in the side chain.

DETAILED DESCRIPTION OF THE INVENTION

The lubricating resin powder to be used in the present invention may include fluorine type resin powder, polyolefin type resin powder, silicone type resin powder, etc. Among them, with respect to lubricating property, fluorine type resin powder is preferred.

As the fluorine type resin powder, polymers of tetrafluoroethylene, trifluorochloroethylene, hexafluoroethylenepropylene, vinyl fluoride, vinylidene fluoride, difluorochloroethylene, trifluoropropylmethylsilane, etc., and copolymers thereof, etc. may be suitably used, but particularly tetrafluoroethylene resin, vinylidene fluoride resin, copolymer resin of tetrafluoroethylene and hexafluoropropylene are preferred. The molecular weight of the resin and the particle size of powder can be suitably selected, but preferably the average particle size may be 0.1 to 10 $\mu$m and the molecular weight 1,000,000 or less.

The amount of the lubricating resin powder added may be suitably 1 to 50% by weight based on the solid component weight in the surface layer.

Further, in the present invention, for improving dispersibility of the lubricating resin powder, it is also effective to add a small amount of a surfactant, a coupling agent, a leveling agent or a fluorine type graft polymer as proposed by the present applicant previously in Japanese Patent Application Nos. 61-58153 and 62-54096 as the dispersing aid.

The silicone type graft polymer to be used in the present invention has a graft structure having silicone in the side chain, and has a function separation structure so as to exhibit lubricating property and compatibility with the binder resin. In other words, so that both the trunk portion and the branch portion in the silicone type graft polymer may be localized, the respective segments are provided with the structure and the characteristics of a polymer or like a polymer.

Accordingly, since the segment in the side chain having silicone has excellent interface migratability, it effects modification of the surface to impart lubricating characteristics and cleaning characteristics thereto. Further, the segment in the main chain having no silicone maintains compatibility with the binder resin and prevents oozing of the polymer onto the surface layer of the photosensitive member.

Such silicone type graft polymer having silicone in the side chain has been previously proposed by the present applicant in U.S. Pat. No. 4,716,091 (corresponding to Japanese Patent Laid-Open Application Nos. 61-189559, 62-75460, 62-75461 and 62-75462). Such silicone type graft polymer, which exhibits surface migratability as mentioned above, exists abundantly on the coating surface, and exhibits excellent mechanical characteristics and excellent lubricating characteristics and cleaning characteristics at the initial stage of using the photosensitive member. However, in recent years, with acceleration of speed or increase in durability in an electrophotographic device such as copying machine or laser beam printer, when the photosensitive member is used for a large number of times, the surface is abraded to loose the surface portion having lubricating characteristic, whereby there is the drawback that its effect will be soon lost.

Accordingly, in the present invention, by using the lubricating resin powder as described above and the silicone type graft polymer in combination, the lubricating characteristics of the surface of the photosensitive member is constantly maintained with the silicone type graft polymer existing on the surface at the initial stage of using the electrophotographic photosensitive member, and also with the lubricating resin powder dispersed in the layer after the surface is abraded with the progress of successive copying, whereby good electrophotographic characteristics can be persistently obtained from the initial stage.

The preferable silicone type graft polymer to be used in the present invention is a compound obtained by copolymerization of a modified silicone which is the condensation reaction product of a silicone represented by the formula (I) and/or the formula (II) shown below with a compound of the formula (III) and/or the formula (IV) and/or the formula (V), and a compound having a polymerizable functional group, having a structure with side chain groups containing silicone bonded as branches to the main chain.

Formula (I)

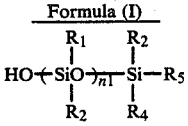

wherein $R_1$, $R_2$, $R_3$, $R_4$ and $R_5$ each represent alkyl group, aryl group or halogenated hydrocarbon, $n_1$ is an average polymerization degree and represents a positive integer;

Formula (II)

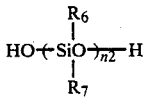

wherein $R_6$ and $R_7$ each represent alkyl group, aryl group or halogenated hydrocarbon, $n_2$ is an average polymerization degree and represents a positive integer;

Formula (III)

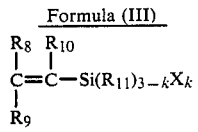

wherein $R_8$, $R_9$ and $R_{10}$ each represent hydrogen atom, halogen atom, alkyl group or aryl group, $R_{11}$ represents alkyl group, aryl group or halogenated hydrocarbon, X represents halogen atom or alkoxy group, k is an integer of 1 to 3;

Formula (IV)

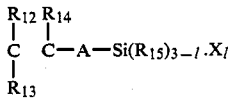

wherein $R_{12}$, $R_{13}$ and $R_{14}$ each represent hydrogen atom, halogen atom, alkyl group or aryl group, $R_{15}$ represents alkyl group, aryl group or halogenated hydrocarbon, A represents arylene group, X represents halogen atom or alkoxy group, l is an integer of 1 to 3;

Formula (V)

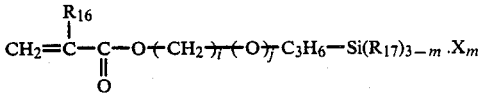

wherein $R_{16}$ represents hydrogen atom, alkyl group or aryl group, aralkyl group, $R_{17}$ represents alkyl group, aryl group or halogenated hydrocarbon, X represents halogen atom or alkoxy group, j is 0 or 1, i is an integer of 0 to 2 when j=0, and 2 when j=1, m is an integer of 1 to 3.

Specific examples of the alkyl group represented by $R_1$, $R_2$, $R_3$, $R_4$, $R_5$, $R_6$ and $R_7$ in the formulae (I) and (II) may include methyl, ethyl, propyl, butyl groups which may be also substituted with halogen atoms, etc. Examples of the aryl group may be phenyl, naphthyl groups, etc. which may also have substituents. Among them, methyl group or phenyl group is preferred. $n_1$, $n_2$ represent average polymerization degrees, preferably 1 to 1,000, particularly 10 to 500.

$R_8$, $R_9$, $R_{10}$, $R_{12}$, $R_{13}$ and $R_{14}$ represented by the formulae (III) and (IV) are hydrogen atom, halogen atoms such as fluorine, chlorine, bromine, iodine, etc., and the alkyl group and the aryl group both may have also substituents, and examples of the alkyl group may include methyl, ethyl, propyl and butyl groups, and examples of the aryl group are phenyl and naphthyl groups. These groups may also have substituents. Among them, hydrogen atom is preferred.

For $R_{11}$ and $R_{15}$, the alkyl group may be methyl, ethyl, propyl and butyl groups, which may be also substituted with halogen atoms, etc. As examples of the aryl group, phenyl, naphthyl groups may be included, which may have also substituents. Among them, methyl and phenyl groups are preferred.

The halogen atom for X may be fluorine, chlorine, bromine, iodine, and among them chlorine atom is preferred. As the alkoxy group, methoxy, ethoxy, propoxy and butoxy groups are included. These groups may also have substituents. Among them, methoxy, ethoxy, 2-methoxy-ethoxy groups are preferred.

A is an arylene group such as phenylene, biphenylene, naphthylene, and these groups may have also substituents.

k and l are an integer of 1 to 3.

$R_{16}$ in the formula (V) represents hydrogen atom, an alkyl group such as methyl, ethyl, propyl, butyl, etc., or an aryl group such as phenyl, naphthyl, etc., and both alkyl group and aryl group may also have substituents. Among them, a hydrogen atom and methyl group are particularly preferred.

For $R_{17}$, the alkyl group may be methyl, ethyl, propyl, butyl groups, etc. and may also be substituted with halogen atoms, etc. As the aryl group, phenyl, naphthyl groups, etc. may be included, which may also have substituents. Among them, methyl and phenyl groups are preferred.

The halogen atom for X may be fluorine, chlorine, bromine, iodine, preferably chlorine atom. As the alkoxy group, methoxy, ethoxy, propoxy, butoxy groups, etc. may be included and may also have substituents. Among them, methoxy, ethoxy, 2-methoxy-ethoxy groups are preferred. m is an integer of 1 to 3.

Specific examples of the compounds of the formulae (I)-(V) are shown below.

Specific examples of the formula (I)

1

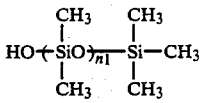

2

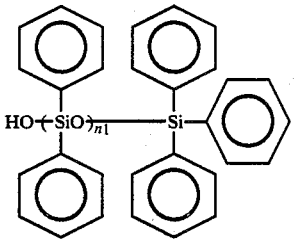

3

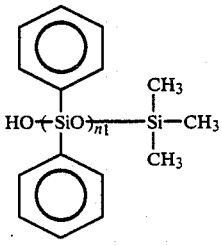

4

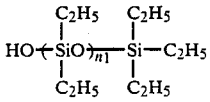

-continued

5

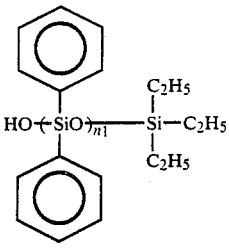

6

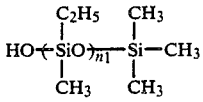

7

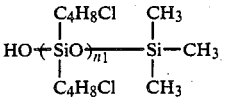

8

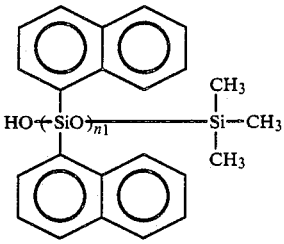

9

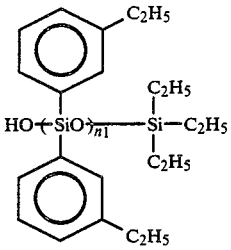

10

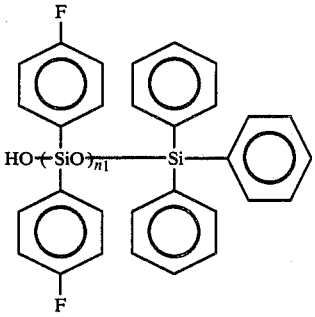

11

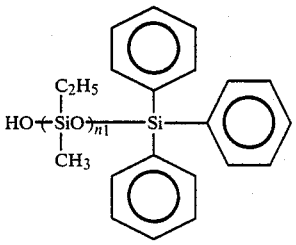

-continued
12
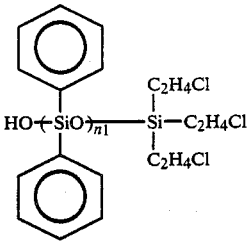
13
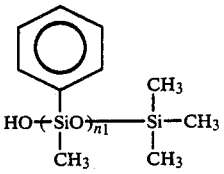
14
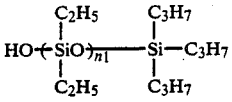
15
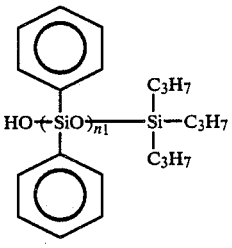
16
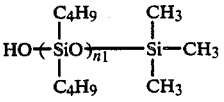
17
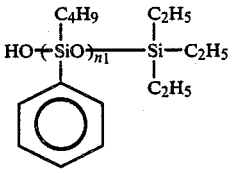
18
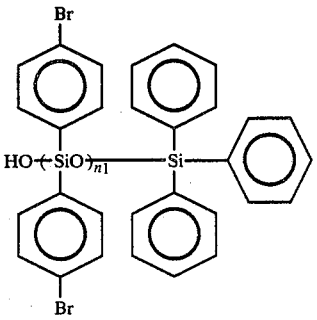
-continued
19
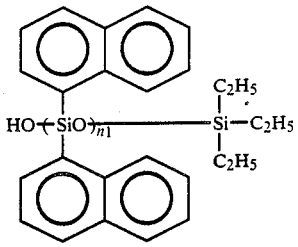
20
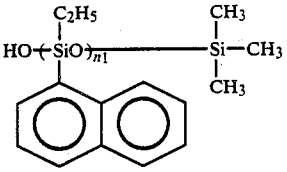
21
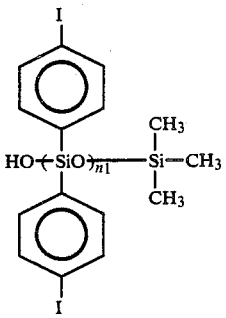
22
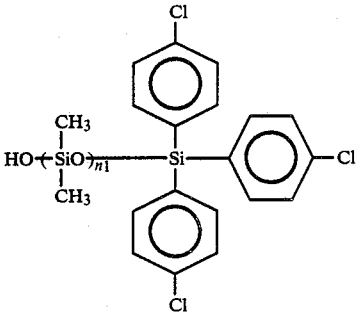
23
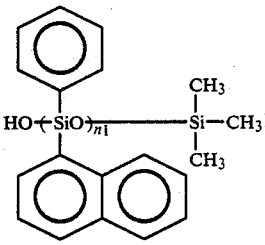
24
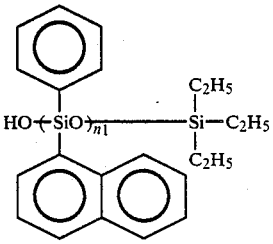

-continued
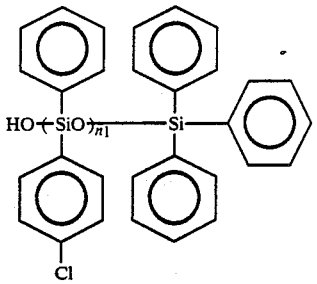
Specific examples of the compounds of the formula (II)
26
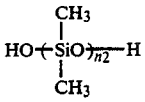
27
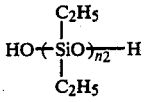
28
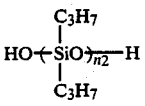
29
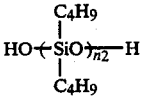
30
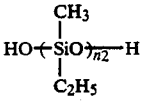
31
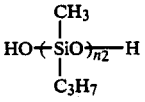
32
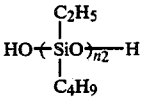
33
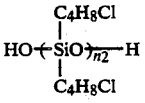
34
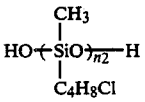
35
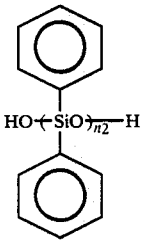
-continued
36
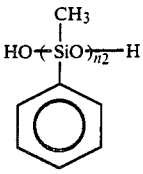
37
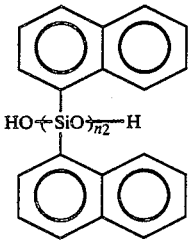
38
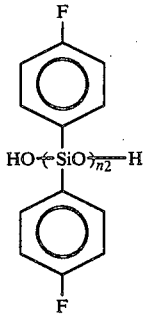
39
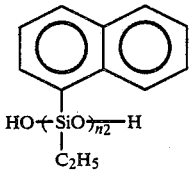
40
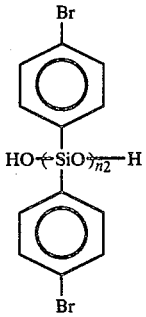
41
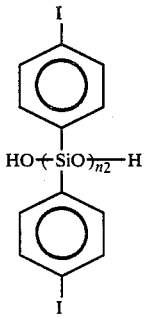

-continued
42
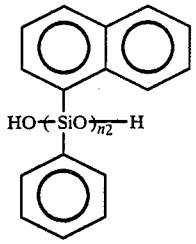
Specific examples of the compounds of the formula (III)
43
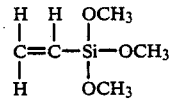
44
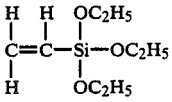
45
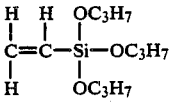
46
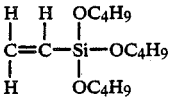
47
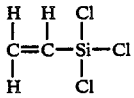
48
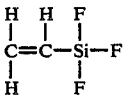
49
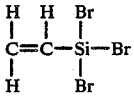
50
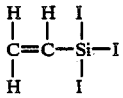
51
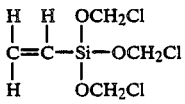
52
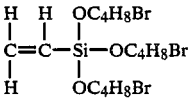
53
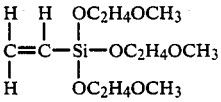
-continued
54
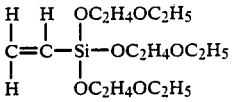
55
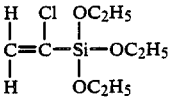
56
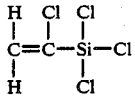
57
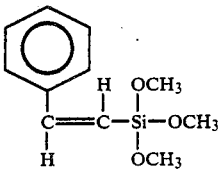
58
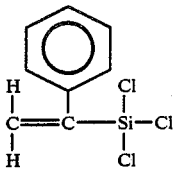
59
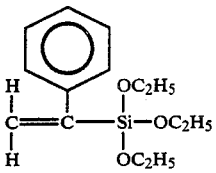
60
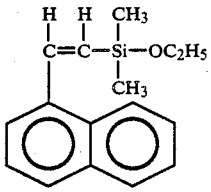
61
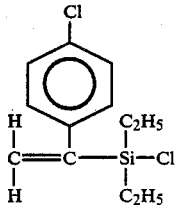
62
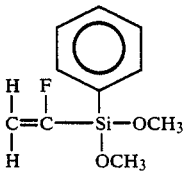

-continued
63
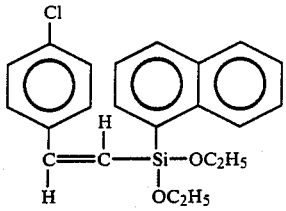
65
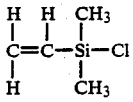
66
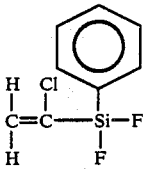
67
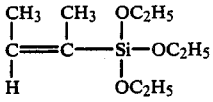
68
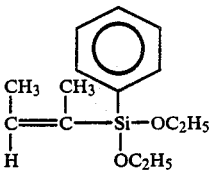
69
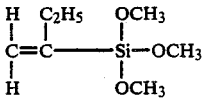
70
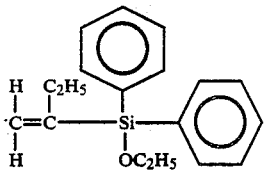
71
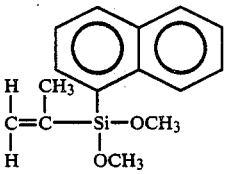
72
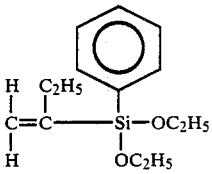
-continued
73
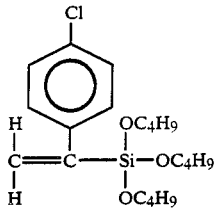
74
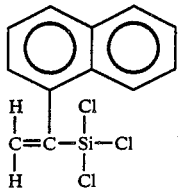
75
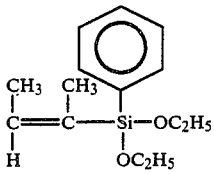
76
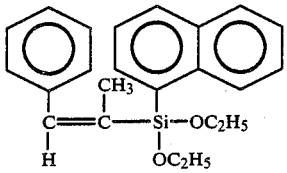
77
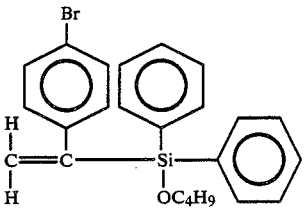
78
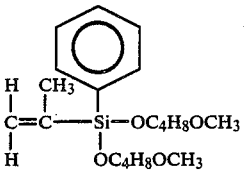
79
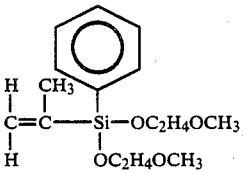
80
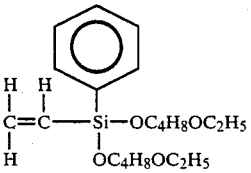

-continued
81
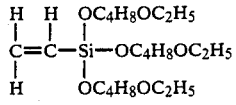
82
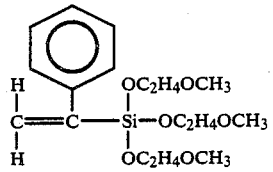
83
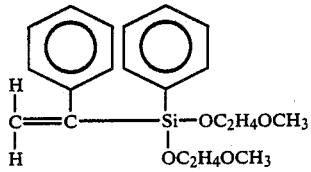
84
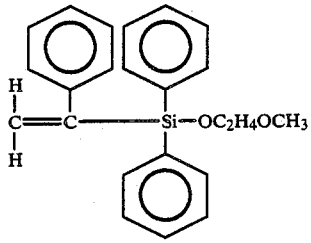
Specific examples of the compounds of the formula (IV)
85
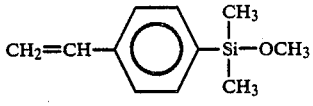
86
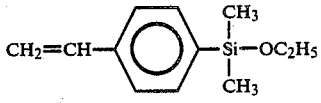
87
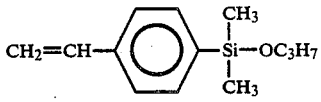
88
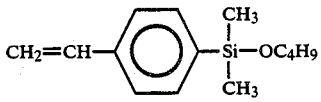
89
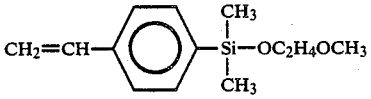
90
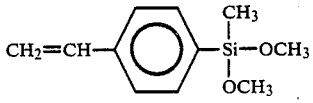
-continued
91
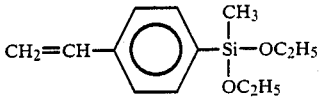
92
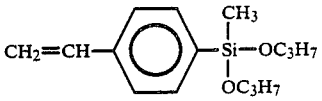
93
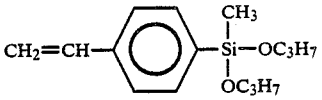
94
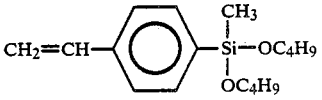
95
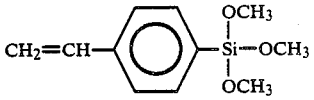
96
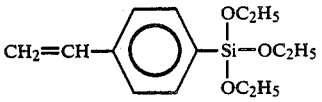
97
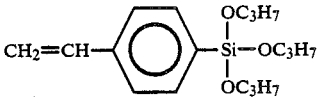
98
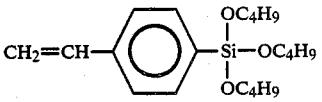
99
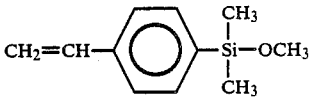
100
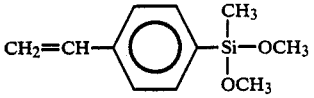
101
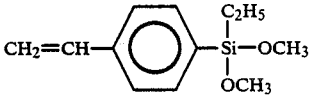
102
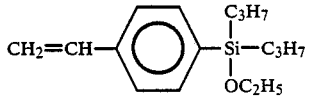
103
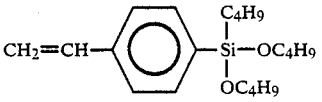

-continued
104
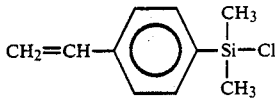
105
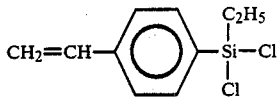
106
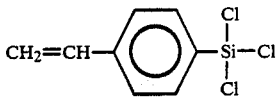
107
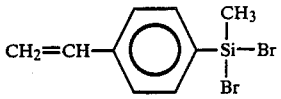
108
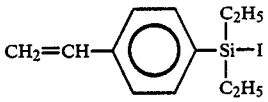
109
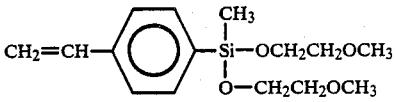
110
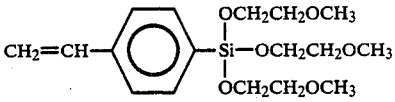
111
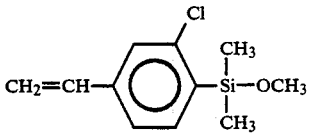
112
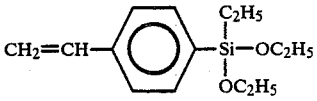
113
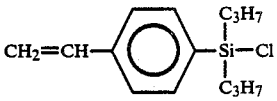
114
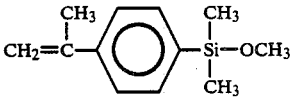
117
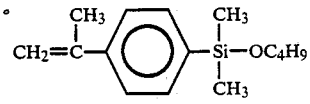
118
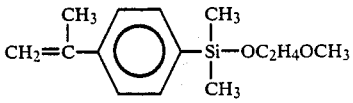
-continued
119
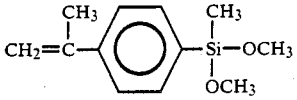
120
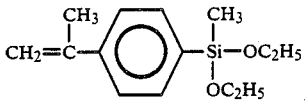
121
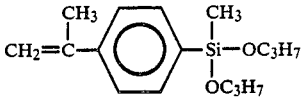
122
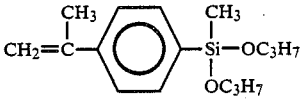
123
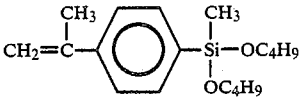
124
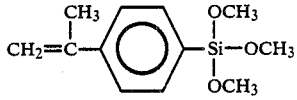
125
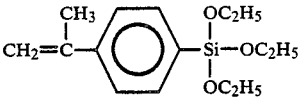
126
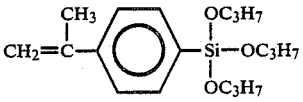
127
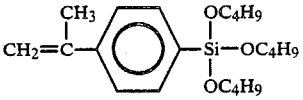
128
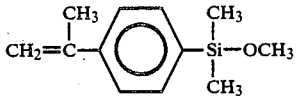
129
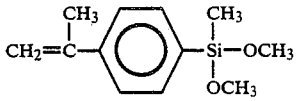
130
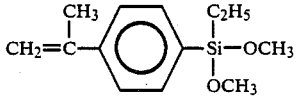
131
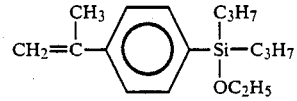

-continued
132
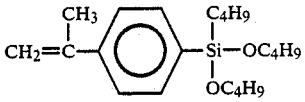
133
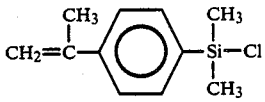
134
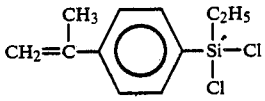
135
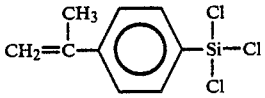
136
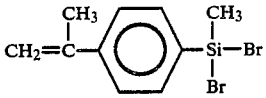
137
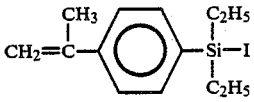
138
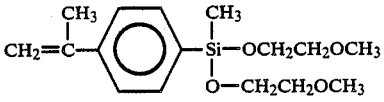
139
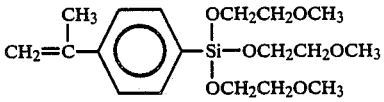
140
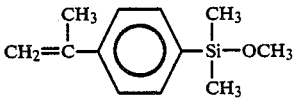
141
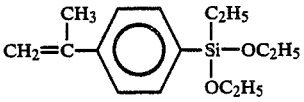
142
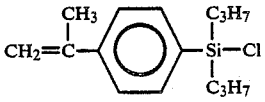
143
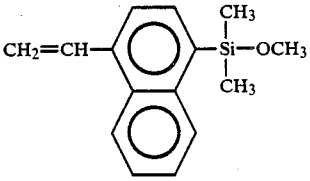
-continued
144
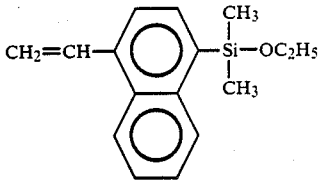
145
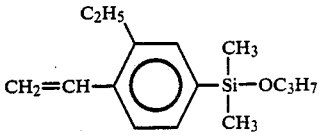
146
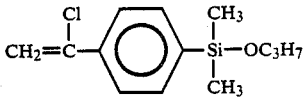
147
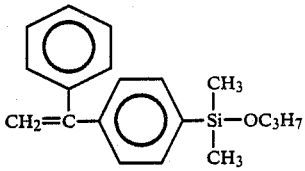
148
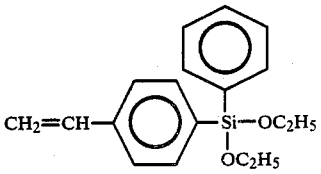
149
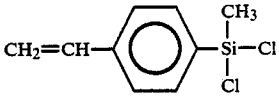
150
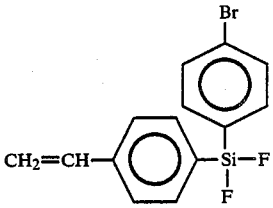
151
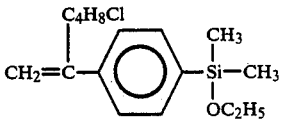
152
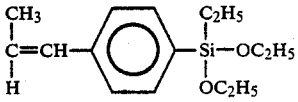
153
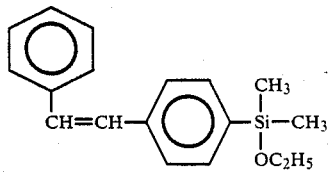

Specific examples of the compounds of the formula (V) No.

154
$$CH_2{=}CH{-}\underset{\underset{O}{\|}}{C}{-}OC_3H_6{-}\overset{\overset{CH_3}{|}}{\underset{\underset{CH_3}{|}}{Si}}{-}OCH_3$$

155
$$CH_2{=}CH{-}\underset{\underset{O}{\|}}{C}{-}OC_3H_6{-}\overset{\overset{CH_3}{|}}{\underset{\underset{CH_3}{|}}{Si}}{-}OC_2H_5$$

156
$$CH_2{=}CH{-}\underset{\underset{O}{\|}}{C}{-}OC_3H_6{-}\overset{\overset{CH_3}{|}}{\underset{\underset{CH_3}{|}}{Si}}{-}OC_3H_7$$

157
$$CH_2{=}CH{-}\underset{\underset{O}{\|}}{C}{-}OC_3H_6{-}\overset{\overset{CH_3}{|}}{\underset{\underset{CH_3}{|}}{Si}}{-}OC_4H_9$$

158
$$CH_2{=}CH{-}\underset{\underset{O}{\|}}{C}{-}OC_3H_6{-}\overset{\overset{CH_3}{|}}{\underset{\underset{CH_3}{|}}{Si}}{-}OC_2H_4OCH_3$$

159
$$CH_2{=}CH{-}\underset{\underset{O}{\|}}{C}{-}OC_3H_6{-}\overset{\overset{CH_3}{|}}{\underset{\underset{OCH_3}{|}}{Si}}{-}OCH_3$$

160
$$CH_2{=}CH{-}\underset{\underset{O}{\|}}{C}{-}OC_3H_6{-}\overset{\overset{CH_3}{|}}{\underset{\underset{OC_2H_5}{|}}{Si}}{-}OC_2H_5$$

161
$$CH_2{=}CH{-}\underset{\underset{O}{\|}}{C}{-}OC_3H_6{-}\overset{\overset{CH_3}{|}}{\underset{\underset{OC_3H_7}{|}}{Si}}{-}OC_3H_7$$

162
$$CH_2{=}CH{-}\underset{\underset{O}{\|}}{C}{-}OC_3H_6{-}\overset{\overset{CH_3}{|}}{\underset{\underset{OC_3H_7}{|}}{Si}}{-}OC_3H_7$$

163
$$CH_2{=}CH{-}\underset{\underset{O}{\|}}{C}{-}OC_3H_6{-}\overset{\overset{CH_3}{|}}{\underset{\underset{OC_4H_9}{|}}{Si}}{-}OC_4H_9$$

164
$$CH_2{=}CH{-}\underset{\underset{O}{\|}}{C}{-}OC_3H_6{-}\overset{\overset{OCH_3}{|}}{\underset{\underset{OCH_3}{|}}{Si}}{-}OCH_3$$

165
$$CH_2{=}CH{-}\underset{\underset{O}{\|}}{C}{-}OC_3H_6{-}\overset{\overset{OC_2H_5}{|}}{\underset{\underset{OC_2H_5}{|}}{Si}}{-}OC_2H_5$$

166
$$CH_2{=}CH{-}\underset{\underset{O}{\|}}{C}{-}OC_3H_6{-}\overset{\overset{OC_3H_7}{|}}{\underset{\underset{OC_3H_7}{|}}{Si}}{-}OC_3H_7$$

167
$$CH_2{=}CH{-}\underset{\underset{O}{\|}}{C}{-}OC_3H_6{-}\overset{\overset{OC_4H_9}{|}}{\underset{\underset{OC_4H_9}{|}}{Si}}{-}OC_4H_9$$

-continued

168
$$CH_2{=}CH{-}\underset{\underset{O}{\|}}{C}{-}OC_4H_8{-}\overset{\overset{CH_3}{|}}{\underset{\underset{CH_3}{|}}{Si}}{-}OCH_3$$

169
$$CH_2{=}CH{-}\underset{\underset{O}{\|}}{C}{-}OC_5H_{10}{-}\overset{\overset{CH_3}{|}}{\underset{\underset{OCH_3}{|}}{Si}}{-}OCH_3$$

170
$$CH_2{=}CH{-}\underset{\underset{O}{\|}}{C}{-}OC_3H_6{-}\overset{\overset{C_2H_5}{|}}{\underset{\underset{OCH_3}{|}}{Si}}{-}OCH_3$$

171
$$CH_2{=}CH{-}\underset{\underset{O}{\|}}{C}{-}OC_3H_6{-}\overset{\overset{C_3H_7}{|}}{\underset{\underset{OC_2H_5}{|}}{Si}}{-}C_3H_7$$

172
$$CH_2{=}CH{-}\underset{\underset{O}{\|}}{C}{-}OC_3H_6{-}\overset{\overset{C_4H_9}{|}}{\underset{\underset{O{-}C_4H_9}{|}}{Si}}{-}OC_4H_9$$

173
$$CH_2{=}CH{-}\underset{\underset{O}{\|}}{C}{-}OC_3H_6{-}\overset{\overset{CH_3}{|}}{\underset{\underset{CH_3}{|}}{Si}}{-}Cl$$

174
$$CH_2{=}CH{-}\underset{\underset{O}{\|}}{C}{-}OC_3H_6{-}\overset{\overset{C_2H_5}{|}}{\underset{\underset{Cl}{|}}{Si}}{-}Cl$$

175
$$CH_2{=}CH{-}\underset{\underset{O}{\|}}{C}{-}OC_3H_6{-}\overset{\overset{Cl}{|}}{\underset{\underset{Cl}{|}}{Si}}{-}Cl$$

176
$$CH_2{=}CH{-}\underset{\underset{O}{\|}}{C}{-}OC_3H_6{-}\overset{\overset{CH_3}{|}}{\underset{\underset{Br}{|}}{Si}}{-}Br$$

177
$$CH_2{=}CH{-}\underset{\underset{O}{\|}}{C}OC_5H_{10}{-}\overset{\overset{C_2H_5}{|}}{\underset{\underset{C_2H_5}{|}}{Si}}{-}I$$

178
$$CH_2{=}CH{-}\underset{\underset{O}{\|}}{C}OC_5H_{10}{-}\overset{\overset{C_2H_5}{|}}{\underset{\underset{C_2H_5}{|}}{Si}}{-}I$$

179
$$CH_2{=}CH{-}\underset{\underset{O}{\|}}{C}{-}OC_4H_8{-}\overset{\overset{OCH_2CH_2OCH_3}{|}}{\underset{\underset{OCH_2CH_2OCH_3}{|}}{Si}}{-}OCH_2CH_2OCH_3$$

180
$$CH_2{=}CH{-}\underset{\underset{O}{\|}}{C}{-}OC_2H_4OC_3H_6{-}\overset{\overset{CH_3}{|}}{\underset{\underset{CH_3}{|}}{Si}}{-}OCH_3$$

181
$$CH_2{=}CH{-}\underset{\underset{O}{\|}}{C}{-}OC_2H_4OC_3H_6{-}\overset{\overset{C_2H_5}{|}}{\underset{\underset{OC_2H_5}{|}}{Si}}{-}OC_2H_5$$

-continued
182
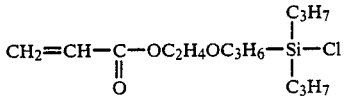
183
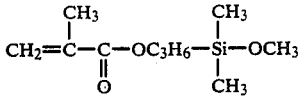
184
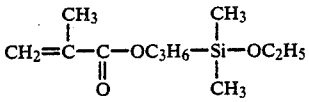
186
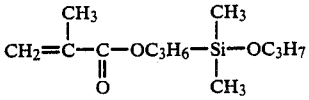
187
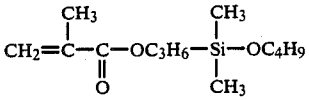
188
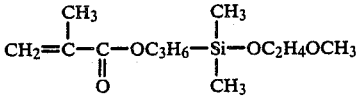
189
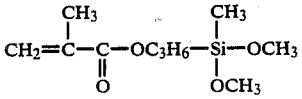
190
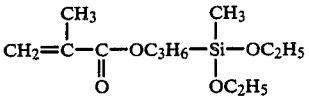
191
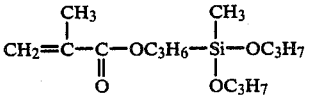
192
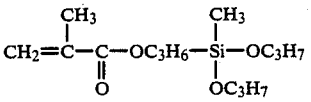
193
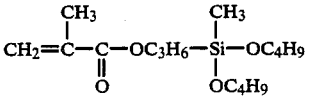
194
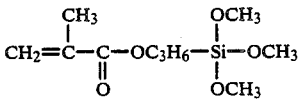
195
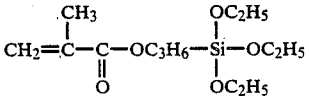
196
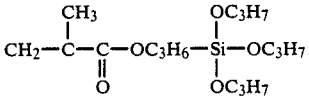
-continued
198
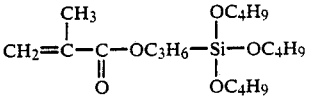
199
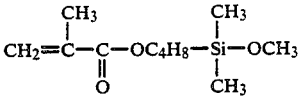
200
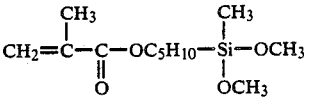
201
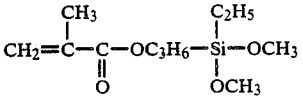
202
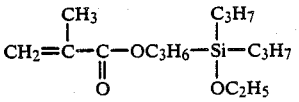
203
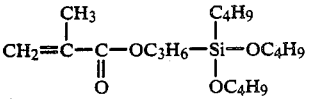
204
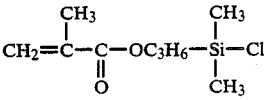
205
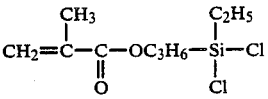
206
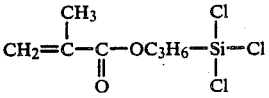
207
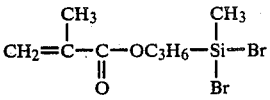
208
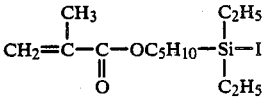
209
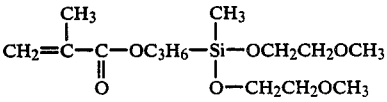
210
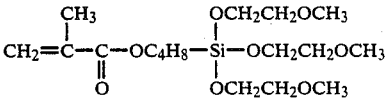
211
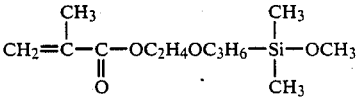

-continued

212

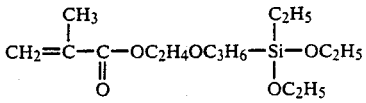

213

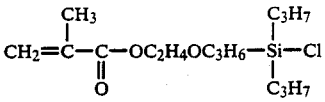

214

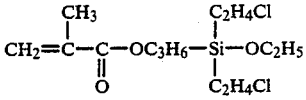

215

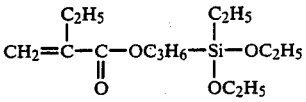

216

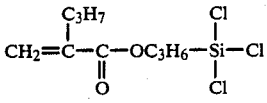

217

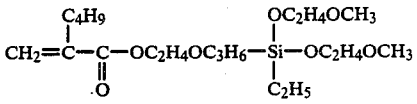

218

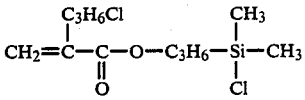

219

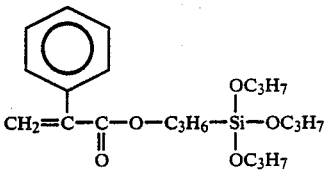

220

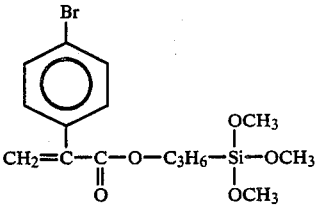

221

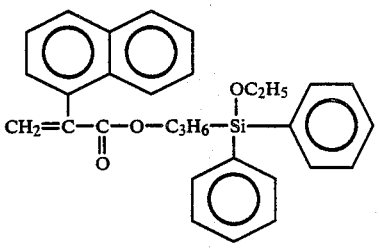

222

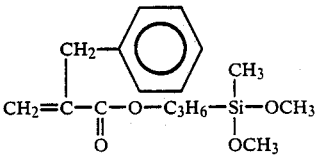

-continued

223

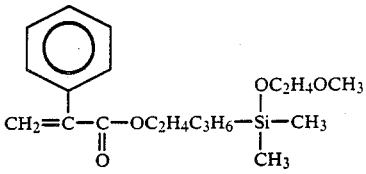

The condensation reaction between the silicones represented by the formula (I) and/or the formula (II) and the compound of the formula (III) and/or the formula (IV) and/or the formula (V) can proceed very smoothly following conventional organic chemical reaction operation, and a stable modified silicone can be obtained by controlling appropriately the reaction molar ratio or the reaction conditions as disclosed in, for example, Japanese Patent Laid-Open Application Nos. 58-167,606 and 59-126,478.

As the compound having polymerizable functional group, there may be included polymerizable monomers or macromonomers comprising polymers having polymerizable functional group at the terminal end having relatively low molecular weight of about 1,000 to 10,000, etc. having no silicone atom. As the polymerizable monomer, examples of the olefinic compound may include low molecular weight straight chain unsaturated hydrocarbons such as ethylene, propylene, butylene, vinyl halides such as vinyl chloride and vinyl fluoride, vinyl esters of organic acids such as vinyl acetate, vinyl aromatic compounds such as styrene, a substituted styrene derivative and vinyl pyridine and vinyl naphthalene and others, acrylic acid, methacrylic acid and acrylic acid, methacrylic acid derivatives including ester, amide of them and acrylonitrile, N-vinyl compounds such as N-vinylcarbazole, N-vinylpyrrolidone and N-vinylcaprolactam, vinyl silicone compounds such as vinyltriethoxysilane, etc. Di-substituted ethylene is also available, and its examples can include vinylidene fluoride, vinylidene chloride, etc., and also esters of maleic anhydride, maleic acid and fumaric acid, etc. may be included.

Particularly, among them, acrylic acid esters, methacrylic acid esters, styrenes, etc. may be preferred. The monomers can be used either singly or as a combination of two or more kinds of monomers.

As the method for polymerization of the silicone type graft polymer, radical polymerization such as solution polymerization, suspension polymerization, bulk polymerization, etc. or ion polymerization may be applicable, but radical polymerization according to solution polymerization is preferred.

The copolymerization ratio may be preferably 5 to 90% by weight, more preferably 10 to 70% by weight, as the content of the silicone type monomer. The molecular weight of the polymer obtained may be preferably 500 to 100,000, particularly 1,000 to 50,000, as the number average molecular weight.

The amount of the silicone type graft polymer added may be suitably 0.01 to 10% by weight, particularly preferably 0.05 to 5% by weight based on the solid component weight in the surface layer. When the amount added is less than 0.01% by weight, no sufficient surface modification effect can be obtained.

The surface layer of the photosensitive member in the present invention is a charge transport layer, when the photosensitive member has a photosensitive layer on the electroconductive substrate, and the photosensitive layer has a structure having a charge transport layer laminated on a charge generation layer. On the other hand, it is a charge generation layer when the photosensitive layer has a structure having a charge generation layer laminated on a charge transmport layer, while it is the single layer when the photosensitive layer is a single layer containing a charge generating material and a charge transporting material in the same layer. Also, when a protective layer is laminated on these photosensitive layers, the surface layer is the protective layer.

The photoconductive material in these photosensitive layers may be preferably an organic photoconductive member.

The binder resin to be used in the present invention may be a polymer having film forming property, but with respect to having hardness to some extent alone and not interfering with transport of carriers, it is preferable to use a polymethacrylic acid ester, a polycarbonate polyarylate, a polyester, a polysulfone, a polystyrene, a copolymer resin of styrene and methacrylic acid ester, etc.

As the electroconductive substrate, a substrate having itself electroconductivity such as aluminum, aluminum alloy, stainless steel, etc. can be used, and otherwise plastics having a layer formed by coating of aluminum, aluminum alloy, indium oxide, tin oxide, indium oxide-tin oxide alloy, etc. according to the vacuum vapor deposition method, or said electroconductive substrate or plastics having a resin layer containing electroconductive particles such as titanium oxide, tin oxide dispersed therein formed by coating, etc. can be used.

Between the electroconductive substrate and the photosensitive layer, a subbing layer having the barrier function and the adhesion function can be also provided. The subbing layer can be formed with casein, polyvinyl alcohol, nitrocellulose, ethyleneacrylic acid copolymer, polyamide (nylon 6, nylon 66, nylon 610, copolymerized nylon, alkoxymethylated nylon, etc.), polyurethane, gelatin, aluminum oxide, etc.

The film thickness of the subbing layer may be appropriately 0.1 to 5 μm, preferably 0.5 to 3 μm.

As the charge generation material, pyrilium, thiopyrilium type dyes, phthalocyanine type pigments, anthanthrone pigments, dibenzopyrenequinone pigments, pyranthrone pigments, trisazo pigments, disazo pigments, azo pigments, indigo pigments, quinacridone type pigments, non-symmetric quinocyanine, quinocyanine, etc. can be used.

As the charge transporting material, fluorenone type compounds, carbazole type compounds, hydrazone type compounds, pyrazoline type compounds, styryl type compounds, oxazole type compounds, thiazole type compounds, triarylmethane type compounds, polyarylalkane type compounds, etc. may be included.

An example of the method for preparation of the photosensitive member of the present invention is described by referring to the case of the function separation type photosensitive member having a charge transport layer laminated on a charge generation layer.

The above charge generating substance is well dispersed together with 0.3 to 10-fold amount of a binder resin and a solvent according to such methods as homogenizer, sonication, ball mill, vibrating ball mill, sand will, attritor, roll mill, etc. The dispersion is applied on a substrate coated with the above subbing layer and dried to form a coating of about 0.1 to 1 μm.

The charge transport layer is formed by dissolving the above charge transporting material and binder resin in a solvent, and the mixing ratio of the charge transporting material and the binder resin coated on the charge generation layer after dispersion of the fluorine type resin powder is about 2:1 to 1:2. As the solvent, one kind or a combination of several kinds of those which can dissolve the binder resin may be used.

During dispersion of the fluorine type resin powder, dispersion can be effected together with the solvent used according to such methods as homogenizer, ball mill, sand mill, attritor, roll mill, colloid mill, etc., whereby uniform dispersion can be obtained easily.

The silicone type graft polymer may be added either before or after dispersion.

Coating can be practiced by use of the coating method such as dip coating, spray coating, spinner coating, bead coating, Meyer bar coating, blade coating, roller coating, curtain coating, etc. Drying should be preferably conducted according to the method of finger touch drying at room temperature, followed by heating drying. Heating drying can be performed stationarily or under air stream at a temperature of 30° C. to 200° C. for a time within the range of 5 minutes to 2 hours.

The thickness of the final charge transport layer is about 5 to 30 μm.

The present invention is described in detail by referring to Examples.

EXAMPLE

Synthesis Example of a Silicone Type Graft polymer

A silicone (0.01 mole) of the specific example No. 26 of the formula (II) ($n_2$: average polymerization degree 300) and 0.012 mole of pyridine were dissolved in 400 ml of diethyl ether, and a 10% diethyl ether solution of the compound (0.005 mole) of the specific example No. 58 of the formula (III) was added dropwise gradually at room temperature over 20 minutes. The reaction proceeded immediately and white crystals of pyridine hydrochloride were precipitated. After completion of the dropwise addition, the mixture was further stirred at room temperature for 1 hour, and the crystals of pyridine hydrochloride were removed by filtration. Next, the filtrate was placed in a separation funnel, and further 500 ml of water was added and water washing was performed by shaking well the mixture. After washing with water, the separation funnel was left to stand to separate the ether layer of the upper layer from the aqueous layer of the lower layer, and anhydrous sodium sulfate was added to the ether layer, and the mixture was left to stand at room temperature overnight to effect dehydration. Then, anhydrous sodium sulfate was removed by filtration, and the resultant filtrate was subjected to distillation under reduced pressure to remove the ether, whereby 165 g of colorless and transparent modified silicone was obtained.

Next, 20 parts by weight (hereinafter called parts) of the modified silicone obtained, 30 parts of styrene, 50 parts of methacrylate, 0.25 parts of azobisisobutyronitrile (hereinafter called AIBN) and 60 parts of toluene were charged into a flask equipped with a condenser and a stirrer, and the reaction was carried out in nitrogen atmosphere at a temperature of 80° C. for 24 hours. After completion of the reaction, the contents in the flask were thrown into a large amount of methanol to effect precipitation of the polymer, followed by filtration to obtain a polymer. Drying under reduced pressure gave 70 parts of a uniform, white oily silicone type graft polymer. Similarly, polymers of other sample No. shown in Table 1 were also synthesized.

TABLE 1

| Synthesis example of silicone type graft polymer | | | | | |
|---|---|---|---|---|---|
| | Modified silicone | | | | Modified |
| Sample No. | formula (I), (II) | formula (III), (IV), (V) | Polymerizable monomer | | silicone monomer |
| a | $n_1$: 1 average 30 | 43 | Methyl methacrylate | 70 parts | 30 parts |
| b | $n_1$: 2 average 30 | 89 | Methyl methacrylate | 80 | 20 |
| c | $n_1$: 7 average 30 | 210 | Styrene | 70 | 30 |
| d | $n_1$: 11 average 30 | 113 | Styrene/ Methyl methacrylate | 60/30 | 10 |
| e | $n_1$: 13 average 300 | 53 | Styrene | 70 | 30 |
| f | $n_1$: 14 average 30 | 217 | Methyl methacrylate | 75 | 25 |
| g | $n_1$: 22 average 300 | 149 | Styrene | 80 | 20 |
| h | $n_2$: 26 average 30 | 193 | Styrene | 80 parts | 20 parts |
| i | $n_2$: 27 average 30 | 43 | Styrene | 85 | 15 |
| j | $n_2$: 29 average 30 | 208 | Styrene/ Methyl methacrylate | 35/35 | 30 |
| k | $n_2$: 26 average 300 | 53 | Styrene/ Methyl methacrylate | 45/45 | 10 |
| l | $n_2$: 35 average 30 | 126 | Styrene | 75 | 25 |
| m | $n_2$: 40 average 30 | 157 | Methyl methacrylate | 85 | 15 |

EXAMPLE 1

On an aluminum cylinder substrate of 80 mm in diameter and 320 mm in length was coated a 5% methanol solution of a polyamide resin (trade name: Amilan CM-8000, produced by Toray) by the dipping method to provide a subbing layer with a thickness of 1 μm. Next, 10 parts (parts by weight, hereinafter the same) of a disazo pigment represented by the following structural formula:

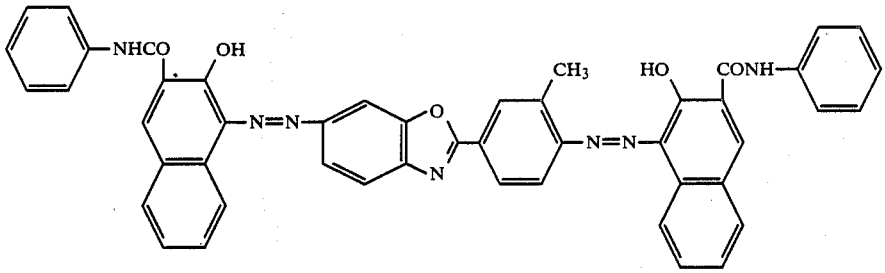

8 parts of a polyvinylbutyral resin (trade name: S-LEC BXL, produced by Sekisui Kagaku K. K.) and 50 parts of cyclohexanone were dispersed by of a sand mill using glass beads of 1 mm in diameter for 20 hours. Into the dispersion were added 70 to 120 (suitable) parts of methyl ethyl ketone, and the dispersion was applied on the subbing layer to form a charge generation layer with a film thickness of 0.15 μm.

Next, 10 parts of a polymethyl methacrylate (weight average melcular weight: 150,000), 5 parts of polytetrafluoroethylene powder as the fluorine type resin powder (average particle size: 0.3 μm, molecular weight: 300,000–400,000, trade name: Lubron L-2, produced by Daikin Kogyo) were dispersed together with 40 parts of monochlorobenzene and 15 parts of THF in a stainless steel ball mill for 50 hours, and in the resultant dispersion were dissolved 10 parts of a hydrazone compound of the structural formula:

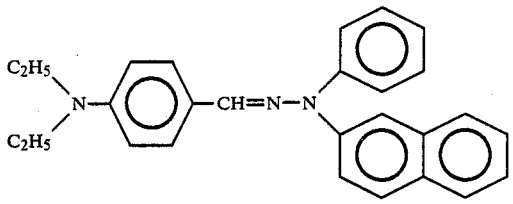

as the charge transport material, and further into this solution was added 0.1% by weight based on the total weight of the above polymethyl methacrylate and the polytetrafluoroethylene powder and the charge transporting material, of the sample No. a of the silicone type graft polymer shown in the above Table 1 to prepare a coating solution for the charge transport layer. The coating solution was applied on the above charge generation layer, followed by hot air drying at 100° C. for 1 hour to form a charge transport layer with a thickness of 19 μm. This is called sample 1. Next, in sample 1, a coating solution containing no silicone type graft polymer in the charge transport layer was used to prepare another sample according to the same method as in sample 1. This is called sample 2.

When the coefficients of friction of the surfaces of these samples 1, 2 were compared in terms of the ratio relative to the coefficient of friction of polyethylene terephthalate film, the following results were obtained.
Sample 1/polyethylene terephthalate: 1.17.
Sample 2/polyethylene terephthalate: 6.08.
Thus, the sample 1 was found to have a coefficient of friction which is about 1/6 of the sample 2.

Next, for samples 1 and 2, image formation was effected according to an electrophotographic process comprising—5.5 kV, corona charging, image exposure, dry toner developing, toner transfer onto plain paper and cleaning with a urethane rubber blade, so that an image of high quality without black streak, etc. could be obtained for the sample 1. On the other hand, in sample 2, reversal rotation of blade occurred at the initial stage of image formation, and therefore flaws were generated on the drum surface and no good image could be obtained.

Next, a drum coated with the same materials as in samples 1, 2 up to the charge generation layer was prepared. On this drum, without use of powder in formation of the layer, a solution containing 10 parts of a polymethyl methacrylate, 10 parts of the above charge transporting material and 0.1% by weight based on the total weight of the polymethyl methacrylate and the charge transporting material, of the silicone type graft polymer used in sample 1 dissolved in a solvent mixture of 40 parts of monochlorobenzene and 15 parts of THF was coated and dried to form a charge transport layer with a thickness of 19 μm. This is called sample 3.

The samples 1 and 3 were compared with respect to durability of 30,000 sheets of image forming continuous papers according to the above electrophotographic process. The results are shown in Table 2.

Image evaluation in the present invention was performed for every 1,000 sheets of continuous papers under the environment of 23° C., 55% RH, and for every 100 sheets under the environment of 32.5° C., 90% RH, and image formation was effected by use of both of a copy sample of half tone and a copy sample of white ground with an image area of 7%, and the image obtained was observed with eyes. The black streak caused by sliding flaw and the ground fog caused by abrasion of the surface of the photosensitive member were judged.

TABLE 2

| Sample | 23° C., 55% RH | 32.5° C., 90% RH |
|---|---|---|
| 1 | Stable images of uniform and high quality without black streak and ground fog recognized at all up to 30000 sheets | the same as the left |
| 3 | One black streak recognized after 7000 sheets, three black streaks and also ground fog recognized after 15000 sheets | the same as the left |

EXAMPLE 2

In Example 1, a polyvinylidene fluoride (trade name: Kaina K-301, produced by Penworld Co.) was used as the fluorine type resin powder and the sample b in Table 1 was used as the silicone type graft polymer, and also in this case the same results as in sample 1 were obtained. The ratio of coefficient of friction in this case was 1.12.

EXAMPLE 3

On an aluminum cylinder substrate of 80 mm in diameter and 320 mm in length was coated a 5% methanol solution of a polyamide resin (trade name: Amilan CM-8000, produced by Toray) by the dipping method to provide a subbing layer with a thickness of 0.5 μm.

Next, 12 parts of a pyrazoline compound having the following structural formula and 10 parts of a bisphenol A type polycarbonate (trade name: Yupilon S-2000, produced by Mitsubishi Gas Kagaku) were dissolved in a solvent mixture of dioxane and dichloromethane.

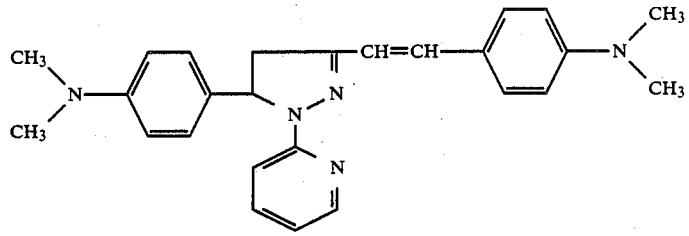

This solution was applied by dipping on the above subbing layer and dried on hot air at 100° C. for 1 hour to form a charge transport layer with a thickness of 17 μm.

Next, 10 parts of a bisazo pigment having the following structural formula:

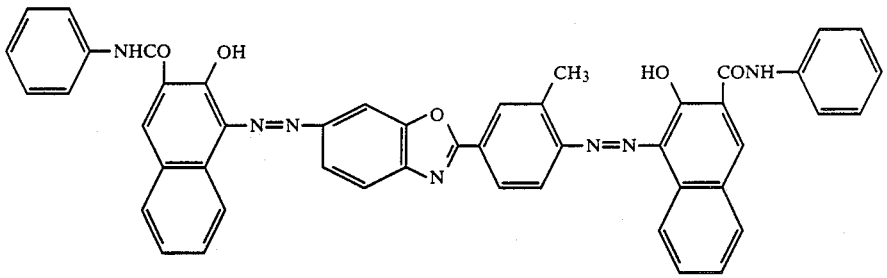

and 5 parts of the polytetrafluoroethylene powder of Example 1 were added into 100 parts of cyclohexanone of a bisphenol Z type polycarbonate (produced by Mitsubishi Gas Kagaku) and dispersion was effected in a stainless steel ball mill for 48 hours. To the solution after dispersion were added 10 parts of the charge transporting material used in Example 1, and further the silicon type graft polymer represented by "c" in the above Table 1 in an amount of 0.1% by weight based on the total weight of the polycarbonate, the bisazo pigment, the charge transporting material and the polytetrafluoroethylene powder. The solution after addition was applied by dipping on the charge transport layer and dried at 100° C. for 20 minutes to form a charge generation layer with a thickness of 3 μm. This is called sample 4. Next, in sample 4, one having a charge generation layer containing no silicone type graft polymer added therein was prepared, and this is called sample 5.

Next, a drum provided with a charge generation layer comprising only the polycarbonate, bisazo pigment, the charge transporting material and the silicone type graft polymer without addition of the fluorine type resin powder in place of the charge generation layer used in samples 4, 5 was prepared, and this is called sample 6. For the samples 4, 5, 6, the coefficients of friction of the surface were compared in terms of the ratio to the coefficient of friction of polyethylene terephthalate film similarly as in Example 1 to obtain the results as follows.

Sample 4/polyethylene terephthalate: 1.20.
Sample 5/polyethylene terephthalate: 6.45.
Sample 6/polyethylene terephthalate: 1.22.

Further, when image formation was effected for the samples 4, 5, 6 according to an electrophotographic process comprising +5.5 kV, corona charging, image exposure, dry toner developing, toner transfer onto plain paper, and cleaning with a urethane rubber blade, good images without black streaks, etc. could be obtained for samples 4 and 6, but for sample 5, because of reversal rotation of the cleaning blade due to deficiency of surface lubricity, flaws were formed on the drum surface to give no good image.

Next, for samples 4, 6, according to the same electrophotographic process as described above, successive image formation on continuous papers of 10000 sheets was performed to obtain the results shown in Table 3.

TABLE 3

| Sample | 23° C., 55% RH | 32.5° C., 90% RH |
|---|---|---|
| 4 | Stable images of high quality obtained without black streak and ground fog recognized up to 10000 sheets | the same as the left |
| 6 | One black streak recognized after 2000 sheets. Three black streaks recognized on 5000 sheets, and further ground fog generated at the white ground portion due to abrasion of the charge generation layer | One black streak recognized after 2300 sheets. White ground fog generated after 5500 sheets. Toner fusion occurred after 1000 sheets. |

EXAMPLE 4

With the use of an aluminum cylinder of 80 mm in diameter and 360 mm in length as the substrate, a 5% methanol solution of a polyamide resin (trade name: Amilan CM-8000, produced by Toray) was applied by dipping thereon to provide a subbing laye of 1 μm.

Next, a mixture of 1 part of aluminum chloride phthalocyanine and 10 parts of a bisphenol Z type polycarbonate (produced by Mitsubishi Gas Kagaku) added to the solvent of 60 parts of cyclohexanone and 15 parts of cyclohexane, together with a mixture of 4 parts of the polyvinylidene fluoride resin powder and a fluorine type graft polymer (trade name: Aron GF-150, produced by Toa Gosei Kagaku) added as the dispersing aid in an amount of 5% by weight (solid content) based on the above polvinylidene fluoride resin powder, was dispersed in a stainless steel ball mill for 48 hours. To the resultant dispersion were added 6 parts of ahydrazone compound of the following structure:

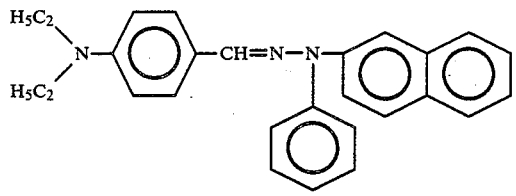

and 0.2% by weight of a silicone type graft polymer represented by the sample d in the above Table 1, and the solution was applied by dipping on the subbing layer to give a photosensitive member provided with a photosensitive layer with a thickness of 20 μm, which is called sample 7.

Next, in the sample 7, no silicone type graft polymer was added to prepare a sample, which is called sample 8. During preparation of the sample 8, a photosensitive member was prepared with a solution in which no polyvinylidene fluoride resin powder was mixed, which is called sample 9. Thus, the sample 7 contains a polyvinylidene fluoride resin and a silicone graft polymer, while the sample 8 contains only the polyvinylidene fluoride resin powder and the sample 9 contains only the silicone type graft polymer.

For samples 7, 8 and 9, the surface friction coefficients were compared to give the following results:
Sample 7/polyethylene terephthalate: 0.78.
Sample 8/polyethylene terephthalate: 5.95.
Sample 9/polyethylene terephthalate: 0.79.

Next, these samples 7, 8, 9 were mounted on an electrohotographic coying machine for plain paper having the means of −5.5 kV, corona charging, image exposure, dry toner development, transfer onto plain paper and cleaning with a urethane rubber blade, and, successive image formation tests on continuous papers of 50000 sheets was conducted at 23° C., 55% RH, and 32.5° C., 90%. The results are shown in Table 4.

TABLE 4

| Sample | 23° C., 55% RH | 32.5° C., 90% RH |
|---|---|---|
| 7 | Uniform, good and stable to images without black streak and ground fog recognized up to 50000 sheets | the same as the left |
| 8 | Surface flaw generated due to initial reversal of cleaning blade, no good image obtained at all and therefore the test discontinued | the same as the left |
| 9 | One black streak recognized after 15000 sheets, four black streaks recognized and further ground fog at the density lowered white ground portion of the black portion due to abrasion after completion of 50000 sheets | the same as the left Toner fusion after 1500 sheets |

EXAMPLES 5-13

Also in the combinations shown in the following Table 5, the same results as in Example 4 were obtained.

TABLE 5

| Example | Fluorine containing resin | Silicone type graft polymer | Initial lubricity relative to polyethylene terephthalate | Result of successive copying |
|---|---|---|---|---|
| 5 | Polytetrafluoroethylene | Sample e 0.1% | 1.11 | Good similarly as in Example 4 |
| 6 | Polytetrafluoroethylene | Sample f 0.1% | 1.21 | the same as above |
| 7 | Polytetrafluoroethylene | Sample g 0.2% | 0.80 | the same as above |
| 8 | Polytetrafluoroethylene | Sample h 0.2% | 0.85 | the same as above |
| 9 | Polytetrafluoroethylene | Sample i 0.5% | 0.51 | the same as above |
| 10 | Polyvinylidene fluoride | Sample j 0.1% | 1.07 | the same as above |
| 11 | Polyvinylidene fluoride | Sample k 2% | 0.31 | the same as above |
| 12 | Polyvinylidene fluoride | Sample l 0.1% | 1.15 | the same as above |
| 13 | Polyvinylidene fluoride | Sample m 0.5% | 0.60 | the same as above |

We claim:

1. An electrophotographic photosensitive member comprising a photosensitive layer on an electroconductive substrate, the surface layer of said photosensitive layer containing lubricating resin powder and a silicone type graft polymer containing silicone in the side chain.

2. An electrophotographic photosensitive member according to claim 1, wherein the lubricating resin powder is selected from the group consisting of fluorine type resin powder, polyolefin type resin powder and silicone type resin powder.

3. An electrophotographic photosensitive member according to claim 1, wherein the lubricating resin powder is fluorine type resin powder.

4. An electrophotographic photosensitive member according to claim 3, wherein the fluorine type resin powder is selected from the group consisting of tetrafluoroethylene resin, vinylidene fluoride resin, and copolymer resin of tetrafluoroethylene and hexafluoropropylene.

5. An electrophotographic photosensitive member according to claim 1 or 3, wherein the silicone type graft polymer is a compound obtained by copolymerization of a modified silicone and a compound having a polymerizable functional group.

6. An electrophotographic photosensitive member according to claim 1 or 3, wherein the silicone type graft polymer is a compound obtained by copolymerization of a modified silicone which is a condensation reaction product of a silicone represented by the formula (I) and/or the formula (II) shown below and a compound of the formula (III) and/or the formula (IV) and/or the formula (V), and a compound having a polymerizable functional group:

Formula (I)

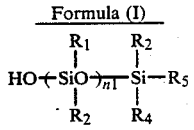

wherein $R_1$, $R_2$, $R_3$, $R_4$ and $R_5$ each represent alkyl group, aryl group or halogenated hydrocarbon, $n_1$ is an average polymerization degree and represents a positive integer;

Formula (II)

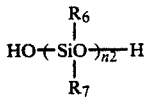

wherein $R_6$ and $R_7$ each represent alkyl group, aryl group or halogenated hydrocarbon, $n_1$ is an average polymerization degree and represents a positive integer;

Formula (III)

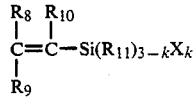

wherein $R_8$, $R_9$ and $R_{10}$ each represent hydrogen atom, halogen atom, alkyl group or aryl group, $R_{11}$ represents alkyl group, aryl group or halogenated hydrocarbon, X represents halogen atom or alkoxy group, k is an integer of 1 to 3;

Formula (IV)

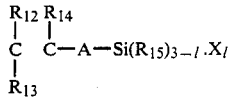

wherein $R_{12}$, $R_{13}$ and $R_{14}$ each represent hydrogen atom, halogen atom, alkyl group or aryl group, $R_{15}$ represents alkyl group, aryl group or halogenated hydrocarbon, A represents arylene group, X represents halogen atom or alkoxy group, l is an integer of 1 to 3;

Formula (V)

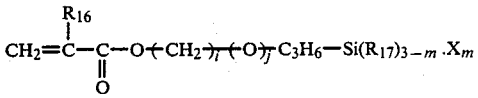

wherein $R_{16}$ represents hydrogen atom, alkyl group, aryl group or aralkyl group, $R_{17}$ represents alkyl group, aryl group or halogenated hydrocarbon, X represents halogen atom or alkoxy group, j is 0 or 1, i is an integer of 0 to 2 when j=0, and 2 when j=1, m is an integer of 1 to 3.

7. An electrophotographic photosensitive member according to claim 1 or 3, wherein the amount of the lubricating resin powder added is 1 to 50% by weight based on the weight of the solide component in the surface layer.

8. An electrophotographic photosensitive member according to claim 1 or 6, wherein the amount of silicone type graft polymer added is 0.01 to 10% by weight based on the weight of the solid component in the surface layer.

9. An electrophotographic photosensitive member according to claim 1, wherein the photoconductive material in the photosensitive layer is an organic photoconductive material.

10. An electrophotographic photosensitive member according to claim 1, wherein the photosensitive layer has a laminated structure of a charge generation layer and a charge transport layer.

11. An electrophotographic photosensitive member according to claim 10, wherein the charge transport layer is provided on the charge generation layer.

12. An electrophotographic photosensitive member according to claim 1 or 9, wherein the photosensitive layer is a single layer.

* * * * *

UNITED STATES PATENT AND TRADEMARK OFFICE

CERTIFICATE OF CORRECTION

PATENT NO. : 4,920,021

DATED : April 24, 1990

INVENTOR(S) : TOMOHIRO KIMURA, ET AL.

It is certified that error appears in the above-identified patent and that said Letters Patent is hereby corrected as shown below:

Title Page:

IN [57] ABSTRACT

Line 4, "silicon" should read --silicone--.

COLUMN 3

Line 50, " Formula (I) $R_1$ $R_2$ " should read

-- Formula (I) $R_1$ $R_3$ --.

COLUMN 4

Line 20, " Formula (IV) $R_{12}$ $R_{14}$ C C — " should read

-- Formula (IV) $R_{12}$ $R_{14}$ C = C — --.

COLUMN 21

Line 2, "No." should be deleted.

UNITED STATES PATENT AND TRADEMARK OFFICE

CERTIFICATE OF CORRECTION

PATENT NO. : 4,920,021

DATED : April 24, 1990

INVENTOR(S) : TOMOHIRO KIMURA, ET AL.

It is certified that error appears in the above-identified patent and that said Letters Patent is hereby corrected as shown below:

COLUMN 22

Line 50, "

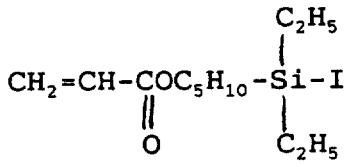

" 178 should read --

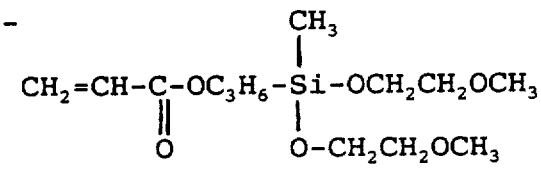

--. 178

COLUMN 23

Line 65, "$CH_2$-C" should read --$CH_2$=C--.

COLUMN 34

Line 43, "ahydra-" should read --a hydra- --.

COLUMN 35

Line 9, "trohotographic" should read --trophotographic--.

UNITED STATES PATENT AND TRADEMARK OFFICE

CERTIFICATE OF CORRECTION

PATENT NO. : 4,920,021

DATED : April 24, 1990

INVENTOR(S) : TOMOHIRO KIMURA, ET AL.

It is certified that error appears in the above-identified patent and that said Letters Patent is hereby corrected as shown below:

COLUMN 36

Line 35, " Formula (I) $R_1$ $R_2$ " should read

-- Formula (I) $R_1$ $R_3$ --.

COLUMN 37

Line 5, " Formula (IV) $R_{12}$ $R_{14}$ C C — " should read

-- Formula (IV) $R_{12}$ $R_{14}$ C = C — --.

UNITED STATES PATENT AND TRADEMARK OFFICE

CERTIFICATE OF CORRECTION

PATENT NO. : 4,920,021

DATED : April 24, 1990

INVENTOR(S) : TOMOHIRO KIMURA, ET AL.

It is certified that error appears in the above-identified patent and that said Letters Patent is hereby corrected as shown below:

COLUMN 38

Line 6, "solide" should read --solid--.

Signed and Sealed this

Twenty-ninth Day of October, 1991

*Attest:*

HARRY F. MANBECK, JR.

*Attesting Officer*

*Commissioner of Patents and Trademarks*